US005839407A

United States Patent [19]

Suzuki et al.

[11] Patent Number: 5,839,407

[45] Date of Patent: Nov. 24, 1998

[54] PISTON OF INTERNAL COMBUSTION ENGINE

[75] Inventors: Takao Suzuki, Numazu; Asami Tsuchiya, Susono, both of Japan

[73] Assignee: Toyota Jidosha Kabushiki Kaisha, Aichi-Ken, Japan

[21] Appl. No.: 868,517

[22] Filed: Jun. 4, 1997

[30] Foreign Application Priority Data

Jun. 11, 1996 [JP] Japan ..... 8-149406

[51] Int. Cl.[6] ..... F02F 3/00

[52] U.S. Cl. ..... 123/193.6; 92/187

[58] Field of Search ..... 123/193.6; 92/187, 92/191

[56] References Cited

U.S. PATENT DOCUMENTS

| | | | |
|---|---|---|---|
| 4,359,973 | 11/1982 | Shimada | 123/193.6 |
| 5,144,923 | 9/1992 | Leites et al. | 123/193.6 |
| 5,307,732 | 5/1994 | Berlinger | 123/193.6 |
| 5,317,958 | 6/1994 | Leites et al. | 123/193.6 |
| 5,549,034 | 8/1996 | Loughlin | 92/187 |

FOREIGN PATENT DOCUMENTS

| | | |
|---|---|---|
| 4-132259 | 12/1992 | Japan . |
| 6-249061 | 9/1994 | Japan . |

*Primary Examiner*—Marguerite McMahon
*Attorney, Agent, or Firm*—Kenyon & Kenyon

[57] ABSTRACT

A piston of an internal combustion engine includes a piston head having an end portion, a bottom surface and an outer peripheral surface. A pin boss extends from the bottom surface of the piston head, the pin boss having an end surface, a piston pin bore in the center of the pin boss and a peripheral portion on the end surface, the end surface being located inside the outer peripheral surface of the piston head. A connecting portion extends from the peripheral portion of the pin boss to the end portion of the piston head, the connecting portion being shaped in accordance with the piston pin bore, the connecting portion having a reinforcement provided thereon.

8 Claims, 7 Drawing Sheets

PISTON OF INTERNAL COMBUSTION ENGINE

BACKGROUND OF THE INVENTION (1) Field of the Invention

The present invention relates to a piston of an internal combustion engine in which a reinforcement of a piston head is incorporated.

(2) Description of the Related Art

A piston of an internal combustion engine generally has a piston head, a pair of skirt areas, a pair of pin bosses, and a pair of supporting areas, the supporting areas connecting the pin bosses with the skirt areas. The pair of pin bosses include a piston pin bore in the center of the pin bosses. When the engine is assembled, a piston pin is fitted into the piston pin bore in the center of the pin bosses, and the piston is connected to a connecting rod through the piston pin. The connecting rod connects a crankshaft of the engine to the piston.

In order to reduce the weight of the piston, end surfaces of the pin bosses below the piston head are formed at inner locations which are inside the piston head. In other words, the end surfaces of the pin bosses are formed such that the distance between the end surfaces of the pin bosses is smaller than the outside diameter of the piston head. Since the pin bosses are provided at such locations, end portions of the piston head project outwardly from the end surfaces of the pin bosses, and the stiffness of such portions of the piston head is relatively low. When the combustion pressure in the combustion chamber is exerted on the piston head in a reciprocating manner, a great amount of deflection of the end portions of the piston head is likely to be produced.

Further, in the piston, a plurality of ring grooves on the outer peripheral surface of the piston are formed. When the engine is assembled, a plurality of piston rings are fitted into the ring grooves. The piston rings are held on the ring grooves of the piston so that the piston can move up and down in a cylinder of the engine while the combustion chamber is pneumatically sealed by the piston rings. When the deflection of the end portions of the piston head is produced, a certain amount of deflection of the ring grooves of the piston is produced, and the piston rings are not suitably held on the ring grooves of the piston due to the deflection of the ring grooves. In such a case, the sealing characteristic of the piston to the cylinder by the piston rings becomes considerably low, which causes the amount of blowby gas in the engine to increase excessively and causes the consumption of lubricating oil in the engine to increase excessively .

In order to avoid the above problem of the sealing characteristic, it is necessary to effectively reduce the deflection of the end portions of the piston head produced when the combustion pressure is exerted on the piston head in the reciprocating manner.

For example, Japanese Laid-Open Utility Model Application No.4-132259 discloses a piston of an engine in which pairs of ribs for supporting the piston head are included. In the piston of the above publication, the pin boss has an end surface and a piston pin bore in the center of the pin boss, the end surface being located inside the outer peripheral surface of the piston head, and the ribs are located on both sides of the pin boss and slantingly extend from the end surface of the pin boss in a direction parallel to the central axis of the piston pin bore. The ribs connect the sides of the pin boss to the end portions of the piston head for supporting the piston head.

However, the deflection of the end portions of the piston head produced due to the combustion pressure on the piston head is mainly influenced by the stiffness of connecting portions from the peripheries of the pin bosses to the end portions of the piston head, especially the deflection is the maximum at the top center portions of the peripheries of the pin bosses adjacent to the end portions of the piston head. Therefore, ,in order to effectively reduce the deflection of the end portions of the piston head, it is desirable to provide a reinforcement of the connecting portions in the piston.

In the piston of the above-mentioned publication, the ribs serve only to reinforce the sides of the pin bosses on the end surfaces thereof. It is difficult for the piston of the above-mentioned publication to effectively reduce the deflection of the end portions of the piston head produced due to the combustion pressure on the piston head. The measure for reinforcing the sides of the pin bosses taken by the piston of the above-mentioned publication has not been adequate to effectively reduce the deflection of the end portions of the piston head.

SUMMARY OF THE INVENTION

An object of the present invention is to provide an improved piston in which the above-described problems are eliminated.

Another object of the present invention is to provide a piston in which the deflection of the end portions of the piston head produced due to the combustion pressure on the piston head is effectively reduced by reinforcement of portions of the piston at which a great amount of the deflection is likely to be produced.

The above-mentioned objects of the present invention are achieved by a piston of an internal combustion engine, which comprises: a piston head which has an end portion, a bottom surface and an outer peripheral surface; a pin boss which extends from the bottom surface of the piston head, the pin boss having an end surface, a piston pin bore in the center of the pin boss and a peripheral portion on the end surface, the end surface being located inside the outer peripheral surface of the piston head; and a connecting portion which extends from the peripheral portion of the pin boss to the end portion of the piston head, the connecting portion being shaped in accordance with the piston pin bore, the connecting portion having a reinforcement provided thereon.

In the piston of the present invention, the end portions of the piston head at which the stiffness is relatively low are appropriately reinforced. Therefore, it is possible for the piston of the present invention to effectively reduce the deflection of the end portions of the piston head due to the combustion pressure on the piston head, by using the reinforcement of the connecting portions from the peripheries of the pin bosses to the end portions of the piston head where a great amount of the deflection is likely to be produced.

BRIEF DESCRIPTION OF THE DRAWINGS

The above and other objects, features and advantages of the present invention will become more apparent from the following detailed description when read in conjunction with the accompanying drawings in which.

DESCRIPTION OF THE PREFERRED EMBODIMENTS

A description will now be given of the preferred embodiments of the present invention with reference to the accompanying drawings.

Figure 1:
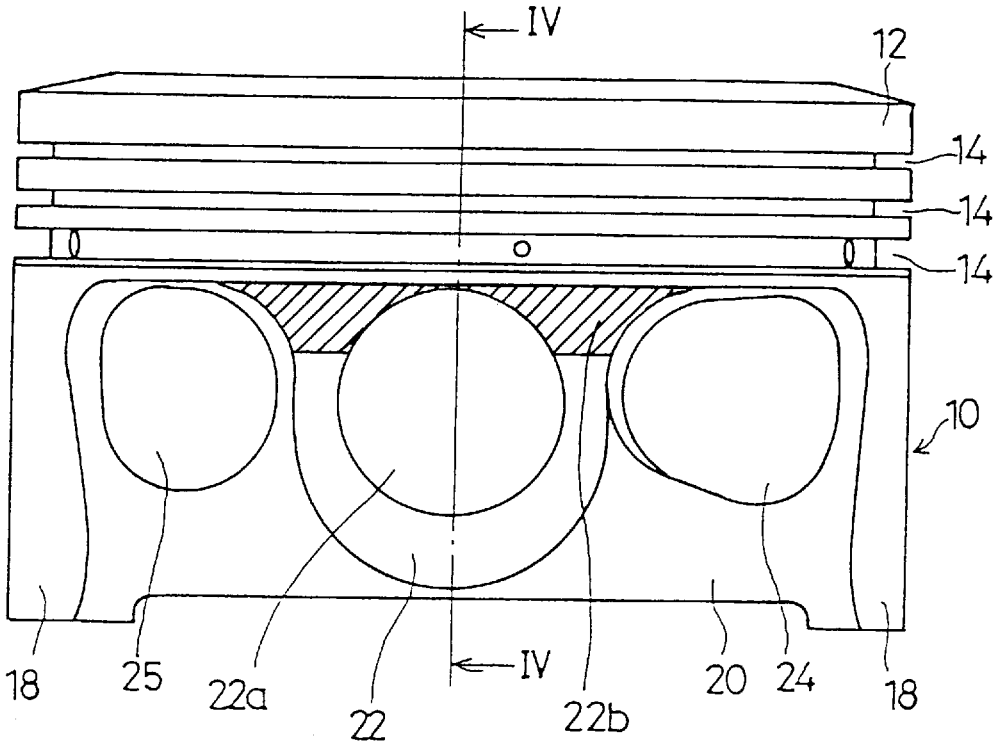
FIG. 1 is a side view of a piston of a first embodiment of the present invention when viewed from a pin boss side thereof.

FIG. 1 shows a piston 10 of a first embodiment of the present invention, when viewed from the pin boss side thereof. In an internal combustion engine, a combustion chamber (not shown) is formed on the upper side of the piston 10 in FIG. 1, and a crankshaft (not shown) is placed on the lower side of the piston 10 in FIG. 1.

Figure 2:
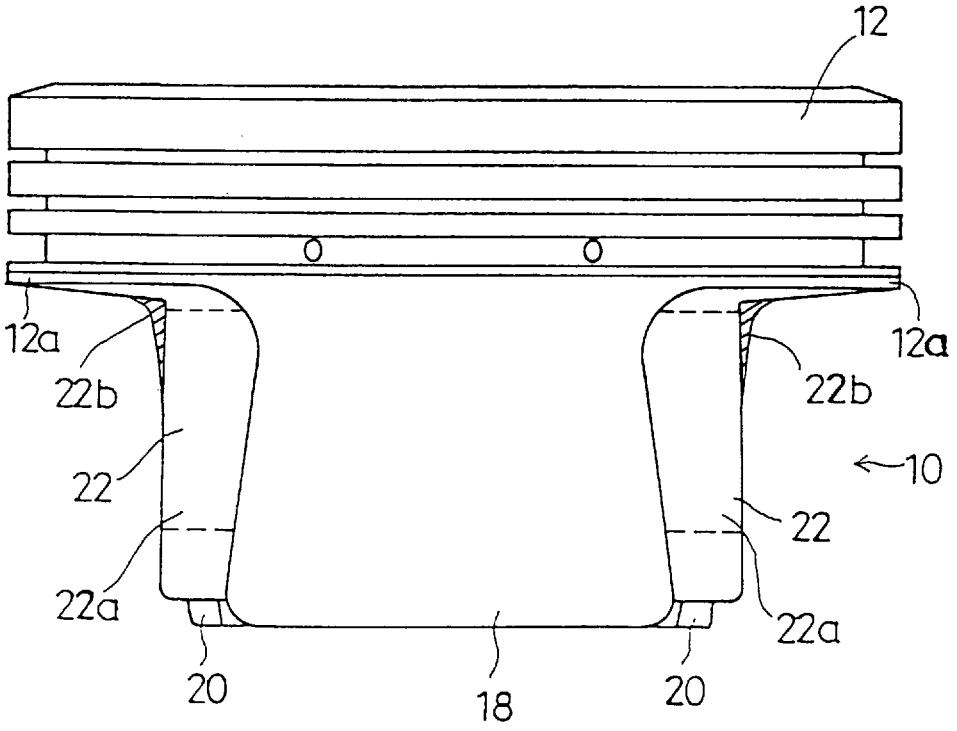
FIG. 2 is a side view of the piston of FIG. 1 when view from a skirt side thereof.
Figure 3:
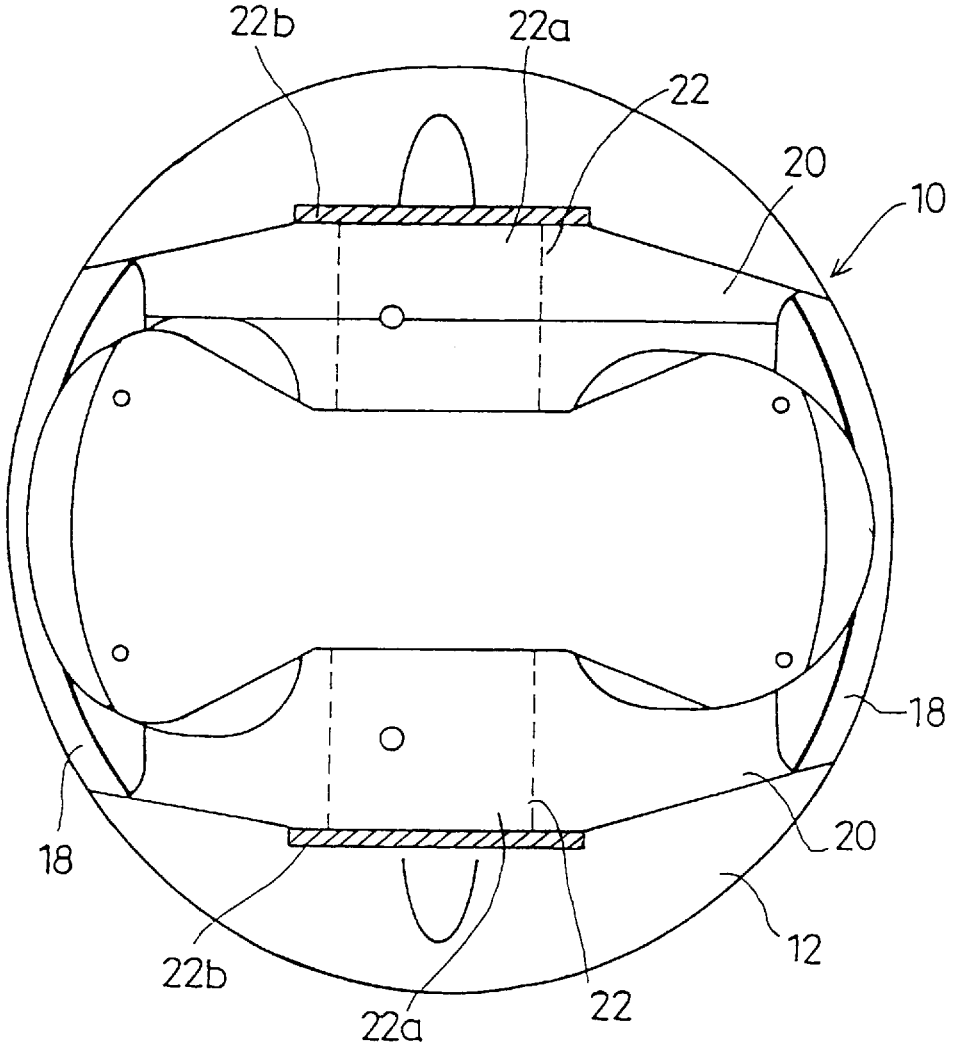
FIG. 3 is a bottom view of the piston of FIG. 1.
Figure 4:
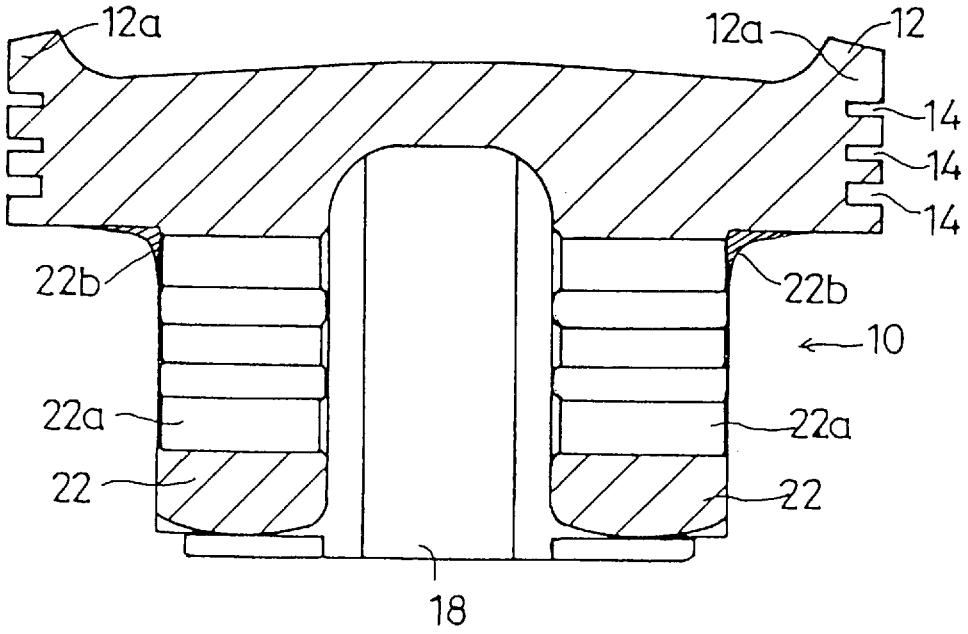
FIG. 4 is a cross-sectional view of the piston taken along a line IV—IV indicated in FIG. 1.

FIG. 2 is a side view of the piston 10 when viewed from a skirt side thereof. FIG. 3 is a bottom view of the piston 10 when viewed from the crankshaft side thereof. FIG. 4 is a cross-sectional view of the piston 10 taken along a line IV—IV indicated in FIG. 1.

The piston 10 is made of an aluminum alloy and integrally formed through casting. As shown in FIGS. 1 through 4, the piston 10 comprises a piston head 12 which forms the bottom of the combustion chamber of the engine. A plurality of ring grooves 14 on the outer peripheral surface of the piston head 12 at the upper side thereof are formed. A plurality of piston rings (not shown) are fitted into the ring grooves 14, and the piston 10 can move up and down in a cylinder of the engine while the combustion chamber is pneumatically sealed by the piston rings on the piston 10.

On the crankshaft side of the piston head 12, a pair of skirt areas 18 and a pair of pin bosses 22 are formed as shown in FIGS. 1 through 4. The pair of skirt areas 18 are provided symmetrically with respect to a central longitudinal axis of the piston 10. The skirt areas 18 downwardly extend from the outer peripheral surface of the piston head 12. The pair of pin bosses 22 are located in the middle of the two skirt areas 18, and they are provided symmetrically with respect to the central longitudinal axis of the piston 10. As shown in FIG. 3, the center line of the skirt areas 18 and the center line of the pin bosses 22 intersect each other at right angles.

Further, on the crankshaft side of the piston head 12, a pair of supporting areas 20 are formed. As shown in FIG. 3, the supporting areas 20 extend between the ends of the skirt areas 18 in a generally horizontal direction, and connect the pin bosses 22 with the skirt areas 18. The pin bosses 22 are located in the middle of the supporting areas 20. The thickness of the pin bosses 22 at the periphery thereof is increased such that the increased thickness is greater than the thickness of portions of the supporting areas 20 extending from the piston head 12.

As shown in FIGS. 1 and 2, the pin bosses 22 have a piston pin bore 22*a* in the center of the pin bosses 22. When the engine is assembled, a piston pin (not shown) is fitted into the piston pin bore 22*a* of the piston 10, and the piston 10 is connected to a connecting rod (not shown) through the piston pin.

On the external surfaces of the piston 10, a pair of connecting portions 22*b* are formed, each connecting portion 22*b* extending from the peripheral portion on the end surface of the pin boss 22 to an end portion 12*a* of the piston head 12. Each of the connecting portions 22*b* includes a reinforcement provided on the connecting portion 22*b*. The reinforcement 23 is shown by the shaded lines of the connecting portions 22*b*. As shown in FIGS. 1–4, the reinforcement 23 is provided above a central axis of the piston pin bore 22*a* and extends over the width of the pin boss 22 on the end surface thereof.

Further, as shown in FIGS. 2 and 4, the outer surface of the reinforcement 23 of each of the connecting portions 22*b* is formed such that it slantingly extends from the end surface of the pin boss 22 on a vertical plane containing the central axis of the piston pin bore 22*a* and smoothly merges with the end portion 12*a* of the piston head 12. The end surfaces of the pin bosses 22 which are located below the connecting portions 22*b* vertically extend at right angles to the bottom surface of the piston head 12. In the present embodiment, the connecting portions 22*b* having the reinforcements 23 provided thereon effectively reduce the deflection of the end portions 12*a* of the piston head 12 produced when the combustion pressure in the combustion chamber of the engine is exerted on the piston head 12 in the reciprocating manner.

Each of the supporting areas 20 includes a pair of openings 24 and 25 provided on the sides of the pin boss 22. The openings 24 and 25 provided in the supporting areas 20 serve to reduce the weight of the piston 10.

When the combustion pressure in the combustion chamber of the engine is exerted on the piston head 12 of the piston 10 in the reciprocating manner, the piston 10 moves up and down in the cylinder of the engine. At the time of the combustion stroke of the engine, the piston 10 transmits the power, obtained by the combustion of fuel in the combustion chamber, to the crankshaft through the connecting rod and the piston pin. During the operation of the engine, compression and expansion reaction forces from the connecting rod are exerted on the pin bosses 22 of the piston 10 through the piston pin. Middle portions of the piston head 12, corresponding to the pin bosses 22 and the intermediate areas between the pin bosses 22, are supported by the pin bosses 22 on the bottom surface of the piston head 12, and the deflection of the middle portions of the piston head 12 due to the combustion pressure on the piston head 12 is relatively small.

On the other hand, when the combustion pressure in the combustion chamber is exerted on the piston head 12 in the reciprocating manner, a great amount of deflection of the end portions 12*a* of the piston head 12 is likely to be produced due to the combustion pressure on the piston head 12. The end portions 12*a* are not supported by the pin bosses 22 on the bottom surface of the piston head 12. Especially, the deflection of the end portions 12*a* of the piston head 12 corresponding to the top center portions of the peripheries of the pin bosses 22 becomes the maximum.

Figure 5:
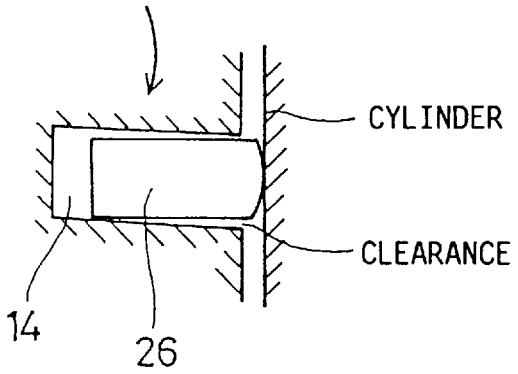
FIG. 5 is a diagram for explaining a condition of a ring groove of the piston with a piston ring fitted thereto when a deflection of the ring groove due to the deflection of the piston head is produced.

When the deflection of the end portions 12*a* of the piston head 12 is produced, a certain amount of deflection of the ring grooves 14 of the piston 10 is produced, and the piston rings are not suitably held on the ring grooves 14 of the piston 10 due to the deflection of the ring grooves 14. FIG. 5 shows a condition of one of the ring grooves 14 of the piston 10 with a piston ring 26 fitted thereto when a deflection of the ring groove 14 due to the deflection of the piston head is produced. As shown in FIG. 5, if the deflection of the ring groove 14 due to the deflection of the piston head is produced, a clearance between the piston ring 26 and the ring groove 14 is formed. In such a case, the sealing characteristic of the piston 10 to the cylinder of the engine by the piston ring 26 becomes considerably low due to the clearance as indicated in FIG. 5. This may cause the amount of blowby gas in the engine to excessively increase or cause the consumption of lubricating oil in the engine to excessively increase.

In the above-described embodiment of FIGS. 1 through 4, the piston 10 includes the connecting portions 22*b* with the reinforcements 23 provided thereon, each connecting portion 22*b* extending from the peripheral portion of the pin boss 22 to the end portion 12*a* of the piston head 12, the connecting portion 22*b* being shaped in accordance with the piston pin bore 22*a*. The connecting portions 22*b* of the piston 10 support the end portions 12*a* of the piston head 12 by the reinforcements 23 provided thereon, and, therefore, the connecting portions 22*b* reduce the deflection of the end portions 12*a* of the piston head 12 produced when the combustion pressure is exerted on the piston head 12.

In particular, each of the connecting portions 22*b* widely extends from the peripheral portion of the pin boss 22 to the end portion 12*a* of the piston head 12 through the top center portion of the periphery of the pin boss 22. As described above, when the combustion pressure is exerted on the piston head 12 in the reciprocating manner, the deflection of the end portions 12*a* of the piston head 12 corresponding to the top center portions of the peripheries of the pin bosses 22 becomes the maximum. In the above-described embodiment, the reinforcement 23 is provided at the locations of the piston 10 where a great amount of the deflection is produced. Therefore, it is possible that the connecting portions 22*b* of the piston 10 of the above-described embodiment effectively reduce the deflection of the end portions 12*a* of the piston head 12.

In the above-described embodiment, the reinforcements 23 of the connecting portions 22*b* of the piston 10 are formed by using a simple slanting surface. The forming of the reinforcements 23 of the connecting portions 22*b* in the piston 10 can be easily accomplished by performing casting with molds in which corresponding slanting surfaces for the connecting portions 22*b* are shaped. A complicated machining operation is not needed to form the reinforcements of the connecting portions 22*b*. Therefore, an increase of the cost of the molds for the forming of the reinforcements 23 of the connecting portions 22*b* in the piston 10 can be made as small as possible. That is, if the piston 10 of the above-described embodiment is used, it is possible to effectively reduce the deflection of the end portions 12*a* of the piston head 12 with no need for considerably increasing the manufacturing cost.

If the piston 10 of the above-described embodiment is used as a semi-floating piston, it is necessary to press fit the piston pin into an opening of the connecting rod when the engine is assembled with the piston 10. In this case, a rotating angle of the piston pin with respect to the piston pin bore 22*a* of the piston 10 is unchanged unless the connecting rod is subjected to swinging motion. A great stress due to the combustion pressure on the piston head 12 is always exerted on the upper surface of the piston pin through the piston pin bore 22*a* on the piston head side thereof. If the stress exerted on the upper surface of the piston pin is excessively increased, a burning or local wearing of the piston pin portion adjacent to the piston pin bore 22*a* may take place.

Figure 6:
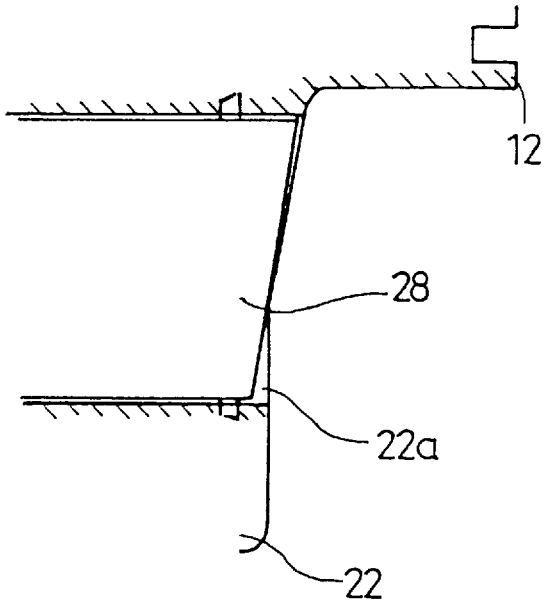
FIG. 6 is a diagram for explaining a condition of a piston pin bore of the piston of FIG. 1 and a piston pin fitted thereto.

In the above-described embodiment, the length of the upper side of the piston pin bore 22*a* on the bottom of the piston head 12 is increased by the reinforcements of the connecting portions 22*b*. FIG. 6 shows a condition of the piston pin bore 22*a* of the piston 10 of FIG. 1 and a piston pin 28 fitted thereto. The shape of the end of the piston pin 28 is also modified in accordance with the piston pin bore 22*a* of the piston 10 whose length is increased by the reinforcements 23 of the connecting portions 22*b* as shown in FIG. 6. A contact area between the piston pin 28 and the upper side of the piston pin bore 22*a* on the bottom of the piston head 12 is increased. Therefore, the stress exerted on the upper surface of the piston pin 28 through the piston pin bore 22*a* due to the combustion pressure on the piston head 12 is reduced. It is possible for the piston 10 of the above-described embodiment to prevent the burning or local wearing of the piston pin portion adjacent to the piston pin bore 22*a*.

Further, if the piston 10 of the above-described embodiment is used as the semi-floating piston, it is necessary to press fit the piston pin into an opening of the connecting rod when the engine is assembled with the piston 10. This press fitting operation must be performed with one of the end surfaces of the pin bosses 22 of the piston 10 being held on a supporting fixture. In the above-described embodiment of FIGS. 1 through 4, the end surfaces of the pin bosses 22 which are located below the connecting portions 22*b* vertically extend at right angles with the bottom surface of the piston head 12. That is, the end surfaces of the pin bosses 22 located below the connecting portions 22*b* are formed as flat surfaces.

Accordingly, if the piston 10 of the above-described embodiment is used as the semi-floating piston during the assembly of the engine, the press fitting operation of the piston pin can be easily performed with one of the end surfaces of the pin bosses 22 of the piston 10 being held on the supporting fixture. Since the end surfaces of the pin bosses 22 are formed as flat surfaces, one of the end surfaces of the pin bosses 22 can be stably held on the supporting fixture. Therefore, if the piston 10 of the above-described embodiment is used, it is possible to easily perform the press fitting operation of the piston pin.

In the above-described embodiment, the outer surface of the reinforcement 23 of each of the connecting portions 22*b* is formed such that it slantingly extends from the end surface of the pin boss 22 and smoothly merges with the end portion 12*a* of the piston head 12. If-a slanting angle of the outer surface of the reinforcement 23 of each of the connecting portions 22*b* relative to the end surface of the pin boss 22 is changed, it is possible to adjust the quantity of the reinforcement 23 provided on each of the connecting portions 22*b*.

Accordingly, if the slanting angle of the outer surface of the reinforcement 23 is increased, the quantity of the reinforcement 23 provided on each of the connecting portions 22*b* can be increased. However, if the quantity of the reinforcement 23 is increased, the wall thickness of the pin bosses 22 is increased and the weight of the piston 10 is also increased. This is not advantageous from the standpoint of the improvement of the performance of the piston 10. Therefore, in order to improve the performance of the piston 10, it is necessary to select an appropriate value of the slanting angle of the outer surface of the reinforcement 23 such that the increase of the weight of the piston 10 is made as small as possible and the deflection of the end portions 12*a* of the piston head 12 is effectively reduced.

Further, in the above-described embodiment, the area in which the reinforcement 23 is provided on each of the connecting portions 22*b* extends over the width of the pin boss 22 on the end surface thereof as shown in FIG. 1. However, the present invention is not limited to this embodiment and modification may be made according to the present invention.

For example, the area in which the reinforcement 23 is provided on each of the connecting portions 22*b* may extend only the width of the pin boss 22 on the end surface thereof, this width of the pin boss 22 being substantially equivalent to the diameter of the piston pin bore 22*a*. If the piston 10 of this modification is used, it is possible to effectively reduce the deflection of the end portions 12*a* of the piston head 12 due to the combustion pressure on the piston head 12. As described above, the deflection is the maximum at the top center portions of the peripheries of the pin bosses 22 adjacent to the end portions 12*a* of the piston head 12.

In the above-mentioned modification, the effect of the reduction of the deflection of the end portions 12*a* of the piston head 12 is smaller than the effect of the reduction in the embodiment of FIGS. 1 through 4. The area of the reinforcement 23 of each of the connecting portions 22*b* in the above modification is also smaller than the area of the reinforcement 23 in the embodiment of FIGS. 1 through 4, and the weight of the piston 10 is reduced. In order to improve the performance of the piston 10, it is necessary that the area of the reinforcement 23 of each of the connecting portions 22*b* be suitably determined such that the increase of the weight of the piston 10 is made as small as possible and the deflection of the end portions 12*a* of the piston head 12 is effectively reduced.

Figure 7:
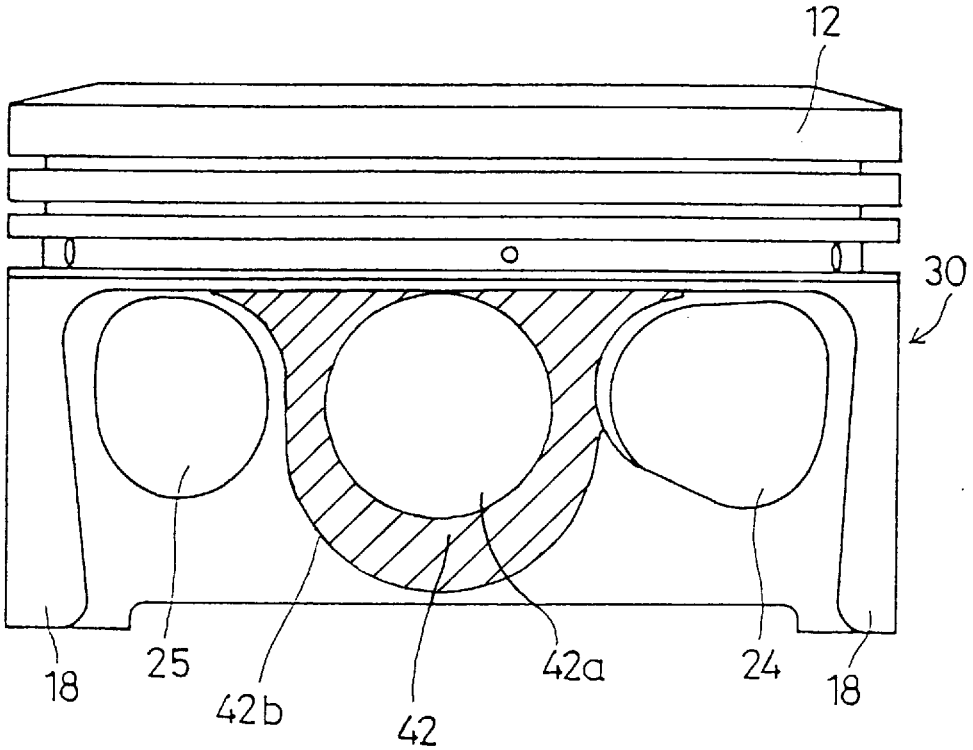
FIG. 7 is a side view of a piston of a second embodiment of the present invention when viewed from a pin boss side thereof.
Figure 8:
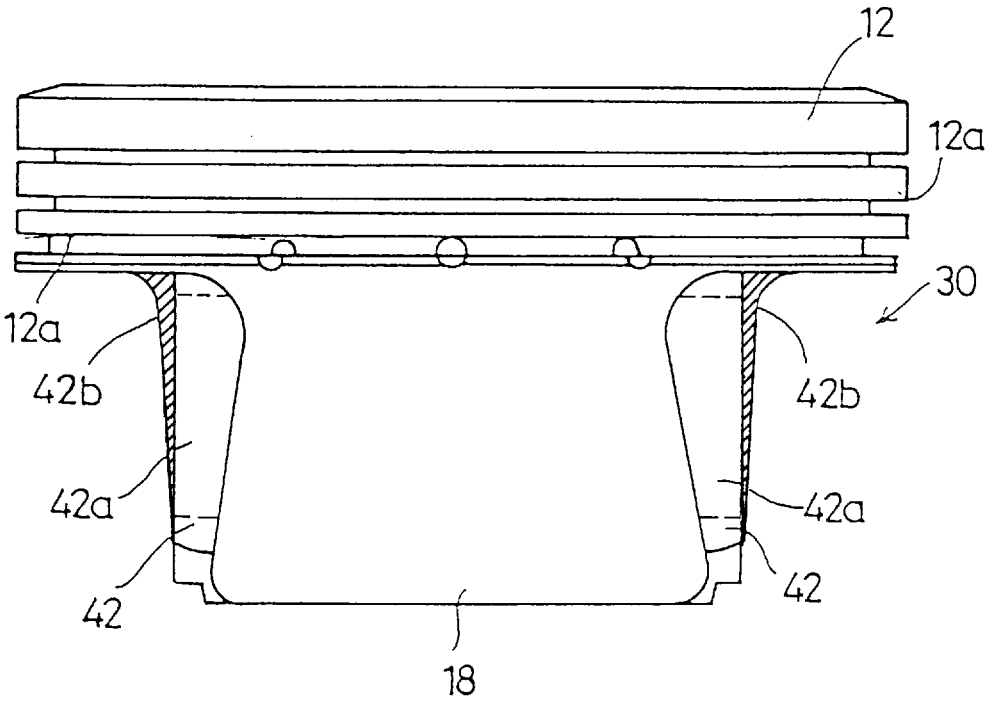
FIG. 8 is a side view of the piston of FIG. 7 when viewed from a skirt side thereof.

Next, FIG. 7 shows a piston 30 of a second embodiment of the present invention when viewed from the pin boss side thereof. FIG. 8 is a side view of the piston 30 of FIG. 7 when viewed from the skirt side thereof.

Figure 9:
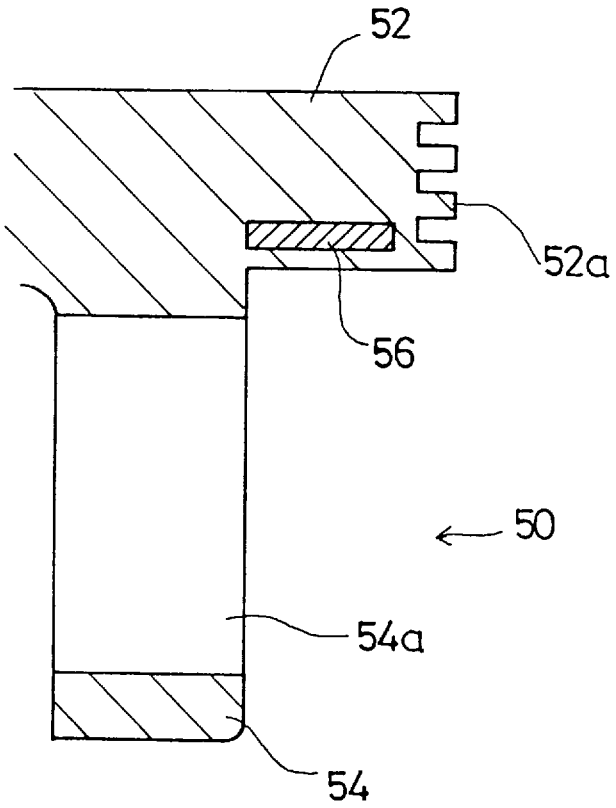
FIG. 9 is a cross-sectional view of a piston of a third embodiment of the present invention in which a reinforcement of a piston head is incorporated.

In FIGS. 7 through 9, the elements which are the same as corresponding elements in FIGS. 1 through 4 are designated by the same reference numerals, and a description thereof will be omitted.

As shown in FIGS. 7 and 8, the piston 30 comprises the pair of skirt areas 18 and a pair of pin bosses 42 which are formed on the crankshaft side of the piston head 12. The pair of pin bosses 42 are located in the middle of the two skirt areas 18, and they are provided symmetrically with respect to the central longitudinal axis of the piston 30.

The pin bosses 42 have a piston pin bore 42*a* in the center of the pin bosses 22. When the engine is assembled, the piston pin is fitted into the piston pin bore 42*a* of the piston 30, and the piston 30 is connected to the connecting rod through the piston pin.

On the external surfaces of the piston 30, a pair of connecting portions 42*b* each of which is provided on the entire end surface of the pin boss 42 and extends to the end portion 12*a* of the piston head 12 are formed. Each of the connecting portions 42*b* includes a reinforcement 43 provided on the connecting portion 42*b*. As indicated by shaded lines in FIGS. 7 and 8, in the present embodiment, the reinforcement 43 of each of the connecting portions 42*b* is provided on the entire end surface of the pin boss 42 and extends over the width of the pin boss 42 on the end surface thereof and toward the end portion 12*a* of the piston head 12.

If the piston 30 of the above-described embodiment is used as a full-floating piston, the piston pin is rotatably fitted onto the opening of the connecting rod when the engine is assembled with the piston 30. In order to avoid the removal of the piston pin from the piston pin bore 42*a* of the piston 30, it is necessary to attach a snap ring to the end of the piston pin outside the pin boss 42 of the piston 30. Therefore, if the piston 30 of the above-described embodiment is used as the full-floating piston, it is necessary to create a space outside the pin boss 43 needed to attach the snap ring to the end of the piston pin. That is, it is necessary that the distance between the end surfaces of the pin bosses 42 within the piston 30 is reduced and a resulting space is substituted for the space needed to attach the snap ring. In this case, the distance from the end surface of each pin boss 42 to the edge of the outer peripheral surface of the piston head 12 is increased, and the stiffness of the end portions 12*a* of the piston head 12 outside the end surfaces of the pin bosses 42 is reduced.

In the above-described embodiment, the stiffness of the end portions 12*a* of the piston head 12 is reduced if the piston 30 is used as the full-floating piston or the distance between the end surfaces of the pin bosses 42 is reduced, and it is necessary to further increase the quantity of the reinforcement 43 provided on each of the connecting portions 42*b* in order to effectively reduce the deflection of the end portions 12*a* of the piston head 12 due to the combustion pressure on the piston head 12.

In the above-described embodiment of FIGS. 7 and 8, the piston 30 comprises the connecting portions 42*b* each of which includes the reinforcement 43 which is provided on the entire end surface of the pin boss 42 and extends over the width of the pin boss 42 on the end surface thereof and toward the end portion 12*a* of the piston head 12. Therefore, the quantity of the reinforcement 43 provided on each of the connecting portions 42*b* of the piston 30 is further increased, and it is possible for the piston 30 of the above-described embodiment to effectively reduce the deflection of the end portions 12*a* of the piston head 12 due to the combustion pressure on the piston head 12 even if the piston 30 is used as the full-floating piston or the distance between the end surfaces of the pin bosses 42 is reduced.

When the piston 30 of the above-described embodiment is used as the full-floating piston, it is not necessary to press fit the piston pin into the opening of the connecting rod when the engine is assembled with the piston 30 as mentioned above with respect to the case of the piston 10 of FIGS. 1 through 4. It is not necessary that the end surfaces of the pin bosses 42 of the piston 30 be formed into the flat surface as shown in FIGS. 1 through 4. It is not necessary that one of the end surfaces of the pin bosses 42 be held on the supporting fixture during the press fitting operation. Therefore, even if each of the connecting portions 42*b* of this embodiment includes the reinforcement 43 provided on the entire end surface of the pin boss 42, the engine can be assembled, without causing any problem, when the piston 30 is used as the full-floating piston.

Further, in the above-described embodiment, the area in which the reinforcement 43 is provided on each of the connecting portions 42*b* may extend only the width of the pin boss 42 on the end surface thereof, this width of the pin boss 42 being substantially equivalent to the diameter of the piston pin bore 42*a*. If the piston 30 of this modification is used, it is possible to effectively reduce the deflection of the end portions 12*a* of the piston head 12 due to the combustion pressure on the piston head 12. As described above, the deflection is the maximum at the top center portions of the peripheries of the pin bosses 42 adjacent to the end portions 12*a* of the piston head 12.

In a case of an in-line, multiple-cylinder engine, a plurality of cylinders within a cylinder block are formed. Generally, the cylinders on both ends of the cylinder block are adequately cooled by the engine cooling water during operation of the engine, but it is difficult to always supply an adequate amount of the engine cooling water to the cylinders in the middle of the cylinder block. For this reason, it is likely that the internal walls of the cylinders on the ends of the cylinder block are set at a relatively low temperature but the internal walls of the cylinders in the middle of the cylinder block are set at a relatively high temperature.

In the case of the in-line, multiple-cylinder engine, a plurality of pistons are arranged within the cylinder block such that the pin bosses of each piston are confronted by each other in the direction in which the cylinders are arrayed in the cylinder block. As described above, the internal walls of the cylinders on the ends of the cylinder block are set at a relatively low temperature but the internal walls of the cylinders in the middle of the cylinder block are set at a relatively high temperature. For this reason, it is likely that the temperature of one of the pin bosses of a certain piston within the cylinder block is different from the temperature of the other pin boss of that piston.

Generally, the increase of the temperature of the piston as well as the combustion pressure on the piston head is the factor to produce the deflection of the end portions of the piston head of the piston. For example, when the temperature of one of the pin bosses of the piston within the cylinder block is higher than the temperature of the other pin boss of the piston, it is desirable that the quantity of the reinforcement 43 provided on the pin boss on the high-temperature side of the piston be increased and the quantity of the reinforcement 43 provided on the other pin boss on the low-temperature side of the piston be reduced. That is, it is desirable that on the pin boss on the high-temperature side of the piston, the effect of the reduction of the deflection of the end portion of the piston head is increased, and, on the pin boss on the low-temperature side of the piston, the effect of the reduction of the weight of the piston is increased. The pistons 10 and 30 of the above-described embodiments make it possible to accomplish the abovementioned matter.

Further, in the above-described embodiment of FIGS. 7 and 8, the reinforcements 43 of the connecting portions 42*b* of the piston 30 are formed by using a simple slanting surface. Similarly to the embodiment of FIGS. 1 through 4, the forming of the reinforcements 43 of the connecting portions 42*b* in the piston 30 can be easily accomplished by performing casting with molds in which corresponding slanting surfaces for the connecting portions 22*b* are shaped.

Alternatively, the forming of the reinforcements 43 of the connecting portions in the piston may be accomplished by using a suitable alloy material with increased stiffness. In the alternative, the stiffness of such material used for the reinforcement 43 must be higher than the stiffness of the aluminum alloy used for the casting of the piston.

Next, FIG. 9 shows a piston 50 of a third embodiment of the present invention in which a reinforcement 56 of a piston head 52 is incorporated.

As shown in FIG. 9, the piston 50 comprises the piston head 52 in which the reinforcement 56 is incorporated by using a reinforcement plate. The reinforcement plate of this embodiment is made of a cast-iron alloy or a steel alloy.

Similarly to the above-described embodiments, the piston 50 comprises a pair of pin bosses 54 which are formed on the crankshaft side of the piston head 52, and the pair of pin bosses 54 are provided symmetrically with respect to the central longitudinal axis of the piston 10. The pin bosses 54 have a piston pin bore 54*a* in the center of the pin bosses 54. End surfaces of the pin bosses 54 below the piston head 52 are formed at inner locations which are inside the piston head 52. The end surfaces of the pin bosses 54 are formed such that the distance between the end surfaces of the pin - bosses 54 is smaller than the outside diameter of the piston head 52. Since the pin bosses 54 are provided at such locations, end portions 52*a* of the piston head 52 outwardly project from the end surfaces of the pin bosses 54.

As shown in FIG. 9, the reinforcement 56 is provided within each of the end portions 52*a* of the piston head 52. The area in which the reinforcement 56 is provided must include areas of the end potions 52*a* of the piston head 52 corresponding to the areas of the piston pin bore 54*a* on the peripheries of the pin bosses 54.

Similarly to the above-described embodiments, the piston 50 is made of an aluminum alloy and integrally formed through casting. Generally, the stiffness of the cast-iron alloy or the steel alloy used for the reinforcement 56 is higher than the stiffness of the aluminum alloy used for the casting of the piston 50. Accordingly, in the piston 50 of the present embodiment, the reinforcement 56 of the piston head 52 is incorporated by using the reinforcement plate, and the stiffness of the end portions 52*a* of the piston head 52 is increased by the reinforcement 56 such that it is higher than the stiffness of the other portions of the piston 50. If the piston 50 of the present embodiment is used, it is possible to effectively reduce the deflection of the end portions 52*a* of the piston head 52 due to the combustion pressure on the piston head 52.

In the above-described embodiment of FIG. 9, the piston 50 can be integrally formed through casting by including the reinforcement 56 in corresponding portions of molds for the end portions 52*a* of the piston head 52 at the start of the casting of the piston 50.

Further, the present invention is not limited to the above-described embodiments, and variations and modifications may be made without departing from the scope of the present invention.

What is claimed is:

1. A piston of an internal combustion engine comprising:

a piston head having an end portion, top and bottom surfaces and an outer peripheral surfacer, wherein a piston axis extends from the top surface downward to the bottom surface;

a pin boss extending from the bottom surface of the piston head, said pin boss having an end surface, a piston pin bore in a center of the pin boss and a peripheral portion on the end surface, said end surface being located within the outer peripheral surface of the piston head; and a connecting portion extending from the peripheral portion of the pin boss to the end portion of the piston head, said connecting portion being shaped in accordance with the piston pin bore, said connecting portion having a reinforcement provided thereon, wherein the reinforcement extends across the pin boss above at least a portion of the pin bore so that a line parallel to the piston axis and extending through the pin bore intersects the reinforcement.

2. The piston according to claim 1, wherein the reinforcement extends on the end surface of the pin boss in a direction substantially perpendicular to a central axis of the piston pin bore.

3. The piston according to claim 1, wherein the reinforcement is provided above a central axis of the piston pin bore.

4. The piston according to claim 1, wherein the reinforcement extends across a width of the pin boss on the end surface thereof.

5. The piston according to claim 1, wherein the reinforcement has an outer surface which slantingly extends from the end surface of the pin boss on a vertical plane containing a central axis of the piston pin bore and smoothly merges with the end portion of the piston head.

6. A piston of an internal combustion engine comprising:

a piston head having an end portion, a bottom surface and an outer peripheral surface;

a pin boss extending from the bottom surface of the piston head, said pin boss having an end surface, a piston pin bore in a center of the pin boss and a peripheral portion on the end surface, said end surface being located within the outer peripheral surface of the piston head; and a connecting portion extending from the peripheral portion of the pin boss to the end portion of the piston head, said connecting portion being shaped in accordance with the piston pin bore, said connecting portion having a reinforcement provided thereon, wherein the reinforcement is provided on the entire end surface of the pin boss.

7. The piston according to claim 3, wherein the reinforcement extends over a width of the pin boss on the end surface thereof toward the end portion of the piston head.

8. A piston of an internal combustion engine comprising:

a piston head having an end portion, a bottom surface and an outer peripheral surface;

a pin boss extending from the bottom surface of the piston head, said pin boss having an end surface, a piston pin bore in a center of the pin boss and a peripheral portion on the end surface, said end surface being located within the outer peripheral surface of the piston head; and a connecting portion extending from the peripheral portion of the pin boss to the end portion of the piston head, said connecting portion being shaped in accordance with the piston pin bore, said connecting portion having a reinforcement provided thereon, wherein the reinforcement increases a length of an upper side of the piston pin bore on the bottom of the piston head, the length of the upper side of the piston pin bore being greater than a length of a lower side of the piston pin bore.

* * * * *

UNITED STATES PATENT AND TRADEMARK OFFICE

CERTIFICATE OF CORRECTION

PATENT NO. : 5,839,407
DATED : November 24, 1998
INVENTOR(S) : Takao Suzuki and Asami Tsuchiya It is certified that error appears in the above-identified patent and that said Letters Patent is hereby corrected as shown below:

Column 1,
Line 50, change "excessively." to -- excessively. --;

Column 2,
Line 8, before "in" delete ",";

Column 6,
Line 52, change "If-a" to -- If a --;

Column 10,
Line 8, change "pin–-bosses" to -- pin bosses --;
Line 46, change "surfacer," to -- surface, --; and Column 12,
Line 1, delete "3" and insert -- 6 --.

Signed and Sealed this

Fifth Day of November, 2002

*Attest:*

*Attesting Officer*

JAMES E. ROGAN
*Director of the United States Patent and Trademark Office*